United States Patent [19]

Lillicrap

[11] Patent Number: 4,947,895

[45] Date of Patent: Aug. 14, 1990

[54] ELECTROMAGNETIC VALVE

[75] Inventor: Douglas C. Lillicrap, Chester, England

[73] Assignee: The Electricity Council, London, England

[21] Appl. No.: 341,780

[22] Filed: Apr. 21, 1989

[30] Foreign Application Priority Data

Apr. 25, 1988 [GB] United Kingdom ..... 8809693

[51] Int. Cl.[5] ..... F15C 1/04

[52] U.S. Cl. ..... 137/807; 137/811; 137/827

[58] Field of Search ..... 137/807, 811, 827

[56] References Cited

U.S. PATENT DOCUMENTS 3,701,357 10/1972 Granström et al. ..... 137/827
4,082,207 4/1978 Garnier et al. ..... 137/827
4,324,266 4/1982 Garnier et al. ..... 137/827
4,655,237 4/1987 Gloor et al. ..... 137/807
4,805,669 2/1989 Lillicrap ..... 137/807

*Primary Examiner*—A. Michael Chambers
*Attorney, Agent, or Firm*—Antonelli, Terry, Stout & Kraus

[57] ABSTRACT

An electromagnetic valve for use for discharge of molten metal from a container comprises a body (1) providing a discharge passage (2, 3) surrounded by an electrical induction coil (4), the passage having a first portion (2) adjacent the container having a radius greater than that of a second portion (3) extending from the first portion to the discharge end of the passage, whereby the frequency of the electric current supplied to the coil (4) can be chosen independently of the passage discharge diameter.

4 Claims, 2 Drawing Sheets

ELECTROMAGNETIC VALVE

BACKGROUND OF THE INVENTION

This invention relates to an electromagnetic valve, and particularly to an electromagnetic valve for use for discharge of molten metal from a container.

In British Patent Publication GB-A No. 777213 there is disclosed a method of controlling or preventing discharge of molten metal from a container through a discharge passage in the container below the level of the molten metal. The method comprises utilizing electromagnetic forces induced in the molten metal by an induction coil disposed around the container to move the molten metal away from the discharge passage in the container. When the coil is not energized the molten metal flows out of the container through the discharge passage under the action of gravity, but when the coil is energized the molten metal is moved away from the discharge passage, and there is no outflow.

When the magnetic field is applied to drive the metal away from the discharge passage, an air/metal interface is formed. As the denser molten metal is above the air, this free surface is inherently unstable. The surface tension and density of the molten metal, plus the magnitude and frequency of the applied magnetic field, determine the maximun extent of the surface for which it remains stable. Typically the maximum dimension of the free surface cannot exceed more than a few tens of millimeters, and this imposes a maximum size on the discharge passage to order to achieve the maximum flow rate required while retaining the ability to shut off the flow by applying the magnetic field.

In French Patent Publication FR-A No. 2316026 there is disclosed such a valve comprising a body providing a discharge passage through which, in use, molten metal will flow from a container under the action of gravity; an electrical induction coil located about the passage; and means to supply a high frequency electric current to the coil, whereby the coil provides an alternating magnetic field which induces electrical currents in molten metal in the passage, interaction between the filed and the currents providing a force which urges the molten metal away from the wall of the passage towards the axis thereof. An electromagnetic overpressure is thus created in the molten metal in the passage, which overpressure can be used to regulate the flow of the molten metal from the container.

In this document it is stated that the frequency f of the electric current supplied to the coil must be sufficiently high for the depth of penetration $\delta$ of the magnetic field into the moltem metal to satisfy the condition:

$$\delta < R \tag{1}$$

where R is the radius of the molten metal stream in the passage before it is caused to contract by the application of the electromagnetic field.

The relationship between the frequency and skin depth is $\delta = \sqrt{1/f\pi\mu\sigma}$ from which it follows that:

$$f > \frac{1}{\pi\mu\sigma R^2} \tag{2}$$

where $\mu$ is the magnetic permeability of the molten metal and $\sigma$ is the electrical conductivity of the molten metal.

Tests show that to achieve efficient flow control, the skin depth $\delta$ should be equal to or less than $\frac{1}{3}$ of the radius R of the molten metal stream in the passage:

$$f \geqq \frac{9}{\pi\mu\sigma R^2} \tag{3}$$

To summarize, the current state of the art teaches that the frequency of the electric current should be sufficiently high for the skin depth to be small compared with the radius of the molten metal stream in the passage.

For the vast majority of molten metal discharge operations, the metal stream diameter lies between 13 and 20 mm. For ferrous alloys, for example, the frequencies to satisfy the equality expressed in (3) therefore lie in the range 80 to 30 kHz. For non-ferrous metals, such as aluminium for example, the frequency range is 15 to 6 kHz. The main interest in electromagnetic flow control valves is for the high melting point alloys, of which the ferrous alloys are the most important. For these alloys, field strengths as high as $\frac{1}{3}$ Tesla might be needed to obtain the required degree of flow control. Currents of a few thousand amps will generally be needed to generate such field strengths. This combination of high current and high frequency poses a difficult electrical engineering problem. The induction coils used as small and have inductances of only a few microhenries, while matching transformers cannot be placed close to the molten metal stream. Thus, a low inductance bus-bar must generally be used to supply the electric current to the coil. A further problem, resulting from the high frequencies required, is that the power dissipated in the coil and the molten metal stream can become very large.

SUMMARY OF THE INVENTION

According to this invention, in an electromagnetic valve as set out above, the passage has a first portion of raduis $R_B$ adjacent the container and a second portion of smaller radius $R_E$ extending from the first portion to the free end of the passage.

The invention provides an electromagnetic valve which allows the frequency of the electric current supplied to the coil to be chosen independently of the passage exit diameter.

BRIEF DESCRIPTION OF THE DRAWINGS

This invention will now be described by way of example with reference to the drawings, in which.

DETAILED DESCRIPTION OF A PREFERRED EMBODIMENT

Figure 1:
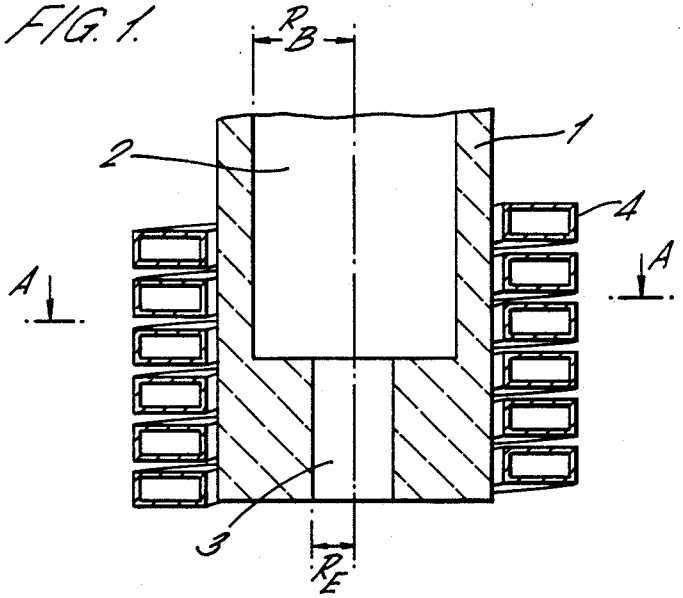
FIG. 1 is a vertical sectional view on the line B—B in FIG. 2 of part of the discharge passage of a valve according to the invention.
Figure 2:
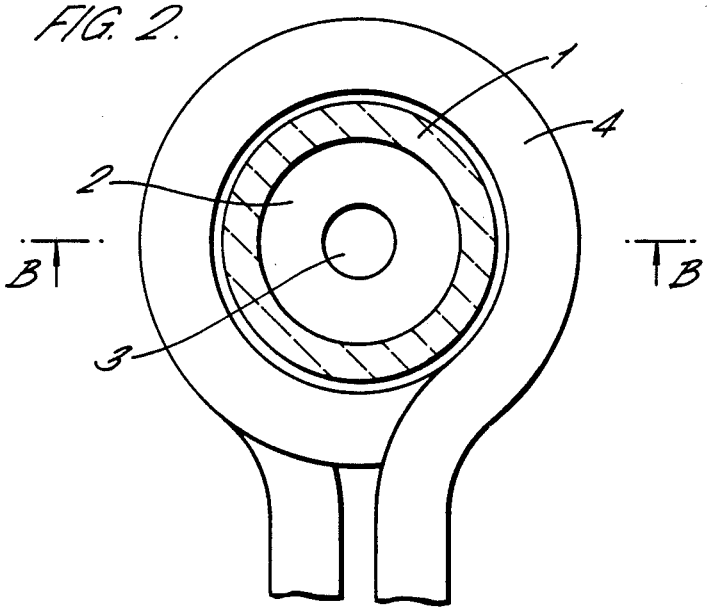
FIG. 2 is a horizontal sectional view on the line A—A in FIG. 1.

The valve shown in FIGS. 1 and 2 has a body 1 of refractory material providing a discharge passage 2, 3 through which, in use, molten metal will flow from a container (not shown) under the action of gravity. The passage first portion 2, has a radius $R_B$ adjacent the container, and the passage second portion 3 has a smaller radius $R_E$, extending from the first portion 2 to the free discharge end of the passage.

A water cooled copper coil 4 surrounds the pasage 2, 3, the mid plane of the coil 4 being level with the junction between passage portions 2 and 3.

When the alternating electric current is supplied in known manner to the coil 4, an alternating magnetic field of peak amplitude B is set up at the circumference of the molten metal in the passage portion 2. The field decays as the centre of the molten metal stream is approached, and for sufficiently high frequencies the field is essentially zero over the central portion of the stream. The induced circumferential currents have a similar distribution, with the maximum current density around the outer circumference of the molten metal stream in the passage portion 2. Interaction between the induced current and the filed B gives rise to an electromagnetic force, directed radially towards the centre of the stream, which is a maximum at the outer circumference of the passage portion 2, and decays to zero over the central portion. An overpressure is therefore created in the central portion of the stream which is equal to the integral of the electromagnetic force along a radius. For the conditions prevailing in the present embodiment this overpressure is approximately $B^2/2\mu$.

For a stream of fluid, such as the molten metal flowing through the passage 2, 3 there is a relationship between velocity and pressure, known as Bernoulli's equation, such that if the pressure increases the velocity decreases. By the proper selection of the frequency f, of the electric current supplied to the coil 4 and the passage radii $R_B$ and $R_E$, the electromagnetic forces create an overpressure $B^2/2\mu$ across the top of the passage portion 3. Thus, the velocity at this position is reduced from $U_o$ for zero field, to U for a field B, where:

$$\frac{U}{U_o} \simeq \sqrt{1 - \frac{B^2}{2\mu\rho gh}} \tag{4}$$

where h is the depth of metal above the top of the passage portion 3, $\rho$ is the density of the molten metal in the passage 2, 3, and g is acceleration due to gravity.

From the above discussion it is clear that to obtain the maximum degree of control of the flow rate through the passage 2, 3, the overpressure $B^2/2\mu$ must be developed over the whole of the passage portion 3. As this overpressure arises from the integrated affect of the electromagnetic forces along a radius between $R_B$ and $R_E$, for maximum efficiency, the electromagnetic force should have decayed to essentially zero over the distance $R_B - R_E$ measured in from the edge of the molten metal stream. For this to be so, the frequency f must be sufficiently high, and therefore the skin depth $\delta$ be sufficiently small, for the field B, and induced currents, to decay to essentially zero over this same distance $R_B - R_E$. For practical purposes it will normally be sufficient to make the skin depth $\delta$ equal to $\frac{1}{3}$ of $R_B - R_E$ and hence the frequency is given by:

$$f \geqq \frac{9}{\pi\mu\sigma(R_B - R_E)^2} \tag{5}$$

When $R_B$ is significantly larger than $R_E$ condition (5) can be simplified to:

$$f \geqq \frac{9}{\pi\mu\sigma R_B^2} \tag{6}$$

Other factors to be considered when selecting the frequency normally outweigh the slight loss of efficiency in satisfying equation (6) rather than equation (5).

Several assumptions are made in deriving equation (4). In particular, it is assumed that the electromagnetic forces do not modify the shape of the streamlines, that is to say, the discharge coefficient for the passage remains unchanged. Insofar as this assumption holds true, the ratio of the velocities across the top of the passage portion 3 is the same as the ratio of the mass flows through the nozzle.

$$\frac{\dot{m}}{\dot{m}_o} = \frac{U}{U_o} = \sqrt{1 - \frac{B^2}{2\mu\rho gh}} \tag{7}$$

where $\dot{m}$ is the mass flow rate for a field value B, and $\dot{m}_o$ is the mass flow rate for zero field strength. According to equation (7) a plot of the square of the mass flow ratio $(\dot{m}/\dot{m}_o)^2$ against the parameter $B^2/2\mu\rho gh$ should be a straight line of slope $-1$. Furthermore, this is a universal plot for all metals. Clearly as $B^2/2\mu\rho gh$ approaches 1, partial levitation of the metal becomes possible, and the metal is pushed away from the wall of the passage by the electromagnetic forces. Under these conditions equation (7) becomes invalid.

Figure 3:
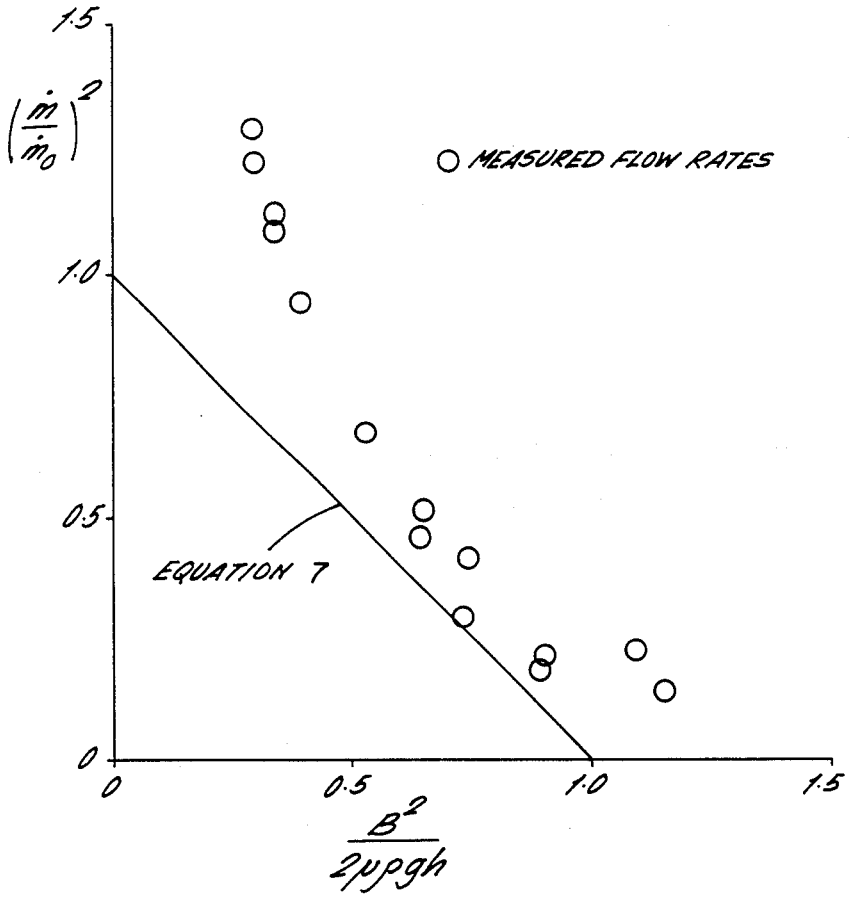
FIG. 3 is a graph illustrating operation of the valve of FIGS. 1 and 2.

In a particular valve in accordance with the invention, the radius $R_B$ of the passage portion 2 was 17 mm and the radius $R_E$ of the passage portion 3 was 6.5 mm. The valve was tested using aluminium and a frequency of 2.14 kHz. Under these conditions $R_B/\delta = 3$ and condition (6) is satisfied. Flow rates $\dot{m}$ were measured for different metal depths h and values of the field B. These values were non-dimensionalised by the flow rate $\dot{m}_o$ for zero field and the same metal depth. The square of this ratio $(\dot{m}/\dot{m}_o)^2$ is plotted against $B^2/2\mu\rho$ gh in FIG. 3. For values of $B^2/2\mu\rho gh$ up to 0.3, the flow rate increases by approximately 10% and the stream is observed to increase in diameter. This is a consequence of the electromagnetic forces modifying the shape of the streamlines and hence improving the discharge coefficient of the valve. For larger values of $B^2/2\mu\rho gh$, the flow rate decreased, tending towards the theoretical performance predicted by equation (7). For the example illustrated, the flow rate can be varied between 110% and 30% of the flow rate for zero field strength.

What is claimed is:

1. An electromagnetic valve, for use in discharge of molten metal from a container, comprising a body providing a discharge passage having a first end adjacent the container and a free end, the passage being adapted for flow of molten metal therethrough from the container under the action of gravity; an electrical induction coil located about the passage; and means for supplying a high frequency electric current to the coil to cause the coil to provide an alternating magnetic field which induces electric currents in molten metal in the passage, interaction between the field and the currents providing a force which urges the molten metal away from the wall of the passage towards the axis thereof, the passage being stepped to provide a first portion of radius $R_B$ adjacent the container and a second portion of smaller radius $R_E$ extending from the first portion to the free end of the passage.

2. A valve as claimed in claim 1, in which the supply means is adapted an electric current with a frequency such that the penetration of the field into the molten metal in the passage, as measured by the skin depth δ, is a fraction of $R_B - R_E$.

3. A valve as claimed in claim 1 or claim 2, in which the frequency (f) of the current satisfies the equation:

$$f \geqq \frac{9}{\pi\mu\sigma(R_B - R_E)^2}$$

where $\mu$ is the magnetic permeability of the molten metal and $\sigma$ is the electrical conductivity of the molten metal.

4. A valve as claimed in claim 1 or claim 2, in which the frequency (f) of the current satisfies the equation:

$$f \geqq \frac{9}{\pi\mu\rho R_B^2}$$

where $\mu$ is the magnetic permeability of the molten metal and $\rho$ is the electrical conductivity of the molten metal.

* * * * *